US006707371B1

(12) United States Patent
Ableitner et al.

(10) Patent No.: US 6,707,371 B1
(45) Date of Patent: Mar. 16, 2004

(54) MAGNETIC ACTUATION OF A SWITCHING DEVICE

(75) Inventors: Jason L. Ableitner, Hopkins, MN (US); Marvin D. Nelson, Savage, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/228,177

(22) Filed: Aug. 26, 2002

(51) Int. Cl.[7] ..... H01H 1/66; H01H 5/02; H01H 9/00

(52) U.S. Cl. ..... 337/344; 335/205

(58) Field of Search ..... 335/205–208; 337/54, 90, 98, 134, 344, 366

(56) References Cited

U.S. PATENT DOCUMENTS

| | | | |
|---|---|---|---|
| 1,749,392 | A | 3/1930 | Penn |
| 1,867,756 | A | 7/1932 | Penn |
| 2,539,259 | A | 1/1951 | McCabe |
| 2,641,664 | A | 6/1953 | Knutson |
| 2,729,719 | A | 1/1956 | Kronmiller |
| 2,782,278 | A | 2/1957 | Peters |
| 3,171,003 | A | 2/1965 | Larsen |
| 3,190,988 | A | 6/1965 | Graham et al. |
| 3,222,474 | A | 12/1965 | Fasola, Jr. |
| 3,573,698 | A | 4/1971 | Mitick |
| 3,593,236 | A | 7/1971 | Beck |
| 3,656,082 | A | 4/1972 | Beck |
| 3,750,068 | A | 7/1973 | Hallin |
| 3,869,619 | A | 3/1975 | Camillo |
| 3,905,003 | A | 9/1975 | Rosenberg et al. |
| 4,243,967 | A | 1/1981 | Frank |
| 4,266,211 | A | 5/1981 | Ulanet |
| 4,274,072 | A | 6/1981 | Gustafson |
| 4,414,520 | A | 11/1983 | Ruuth |
| 4,748,432 | A | 5/1988 | Yamada |
| 5,148,142 | A | 9/1992 | Buckshaw et al. |
| 5,166,657 | A | 11/1992 | Buckshaw et al. |
| 5,194,842 | A | 3/1993 | Lau et al. |
| 5,262,752 | A | 11/1993 | Truong et al. |
| 6,040,749 | A | 3/2000 | Youngner et al. |
| 6,246,305 | B1 | 6/2001 | Youngner et al. |

OTHER PUBLICATIONS

General Technical Bulletin #13—*Low Energy Switching*; Honeywell Inc.—MICRO SWITCH Semsing and Control, No date.

HONEYWELL INC., "Thermostats T87F," publication, Form No. 60–2222–2, S.M. Rev. 4–86, Apr. 1986.

HONEYWELL INC., "T87F Universal Thermostat," publication, Form No. 60–0830–3, S.M. Rev. 8–93, Aug. 1993.

Exhibits A–E, Photographs of a Hunter Thermostat, no date.

Exhibits F & G, Photographs of an Evcon Thermostat, Model 7670/368, no date.

(List continued on next page.)

*Primary Examiner*—Ramon M. Barrera

(57) ABSTRACT

A control device including a switch with a ferromagnetic armature moving between a first position and a second position. The armature actuates a plunger that causes the switch to snap from an open position to a closed position. An energy-storing member may be positioned adjacent the ferromagnetic armature, the energy-storing member moving a magnet between an attracting position and a non-attracting position based on a temperature of an environment surrounding the energy-storing member. When the energy-storing member positions the magnet in the attracting position, the magnet causes the armature to snap from the first position to the second position, thereby actuating the plunger and causing the switch to snap from the open position to the closed position. A ferromagnetic backstop may also be positioned adjacent the magnet and coupled to the energy-storing member to hold the magnet and the energy-storing member in the non-attracting position.

20 Claims, 7 Drawing Sheets

OTHER PUBLICATIONS

Exhibit H, Photographs of a Robertshaw Thermostat, Exhibit H Model 255/4–4, Exhibit I Model 6E 311T76A1B55, no date.

Exhibit I, Photographs of a GE Thermostat, Model 3AAT76A1B55, no date.

Exhibits J & K, Photographs of a White–Rodgers Thermostat, Model ID56–347, no date.

Exhibits L–O, Photographs of a Columbus Electric Thermostat, no date.

Exhibits P–T, Photographs of a Honeywell Thermostat, Model T87F, no date.

Exhibits U–Z, Photographs of a Honeywell Thermostat, Model T810D, no date.

Exhibits AA–GG, Photographs of a Robertshaw Thermostat, Model TX400, no date.

Exhibits HH–KK, Photographs of a White–Rodgers Thermostat, Model 1C30–321, no date.

Exhibits LL–OO, Photographs of a White–Rodgers Thermostat, Model 1C30–333, no date.

Exhibits PP–SS, Photographs of a Robertshaw Thermostat, Model 9204H, no date.

Exhibits TT–WW, Photographs of a White–Rodgers Thermostat, Model 1C20, no date.

White–Rodgers, Installation Instructions for Champagne Astro*Stat, Part No. 37–1759–2, no date.

Robertshaw, Installation Guide for Series 9200 Mercury–Free Mechanical Thermostats, Part No. 34790, 1999, No month.

Robertshaw, Installation Data for TX400 Heating/Cooling 24 Volt Thermostat (CM260), Form No. 1–004J, Nov. 1982.

Robertshaw, Installation Data for DA490–400 Subbase Uni–Kit, Form No. 1–295J, Apr. 1989.

Honeywell, Installation Instructions for TS810C, D; TS810B, Heating or Cooling Thermostats, Form No. 69–0219–9, Jan. 2003.

White–Rodgers, Installation Instructions for Heating only 1C20 and Heating and Cooling 1C26, Part No. 37–6335A, no date.

MAGNETIC ACTUATION OF A SWITCHING DEVICE

RELATED APPLICATION

This application is related to a co-pending and co-owned patent application entitled "Methods and Apparatus for Actuating and Deactuating a Switching Device Using Magnets," Honeywell Docket No. H0003288, U.S. Ser. No. 10/228,708, filed on Aug. 26, 2002.

TECHNICAL FIELD

The present invention generally relates to electro-mechanical switches and energy-storing actuators. In addition, the present invention relates to electro-mechanical switches and energy-storing actuators that can be adapted for use with thermostats.

BACKGROUND

Electro-mechanical switches are utilized in a variety of industrial, consumer and commercial applications. Certain types of electrical switching applications require a mechanical switch that can operate properly with a slowly-applied, low-actuation force. Such a switch must also be extremely reliable and generate an accurate, repeatable response, while possessing a small actuation differential and/or low energy requirement. These requirements arise perhaps most commonly in applications involving electro-mechanical thermostats, which are utilized for controlling heating and cooling in homes and buildings where coils of standard bimetal strips form the switch actuation elements. For many years this thermostatic switching function has been performed by mercury bulb switch elements.

Due to the environmental concerns associated with the use of mercury, it is anticipated that electro-mechanical switches will eventually replace mercury-based switches. Legislation currently being drafted and passed in a variety of countries, including the United States, is aimed at banning the use of mercury in most consumer-based applications. Thus, non-mercury based switches must be developed to replace such mercury-type switching mechanisms.

Some attempts have been made at replacing mercury-switching devices. For example, so-called "snap action" switches have been designed to address the environmental concerns that mercury bulb switch elements raise. As utilized herein, the term "snap action switch" generally refers to a low actuation force switch, which utilizes an internal mechanism to rapidly shift or snap the movable contact from one position to another, thus making or breaking electrical conduction between the movable contact and a fixed contact in response to moving an operating element of the switch, such as a plunger, a lever, a spring, or the like from a first to a second operating position. Typically, these switches require only a few millimeters of movement by the operating element to change the conduction state of the switch.

Such switches can safely and reliably operate at a current level of several amperes using the standard 24 VAC power that thermostats control. However, when actuated by a slowly-applied, low-actuation force such as is provided by a thermostat's coiled bimetal strip, snap action switches may occasionally hang in a state between the two conducting states, or may switch so slowly between the two conducting states that unacceptable arcing and/or increased temperature can occur when entering the non-conducting state. Either condition gives rise to unacceptable reliability and predictability of operation. Furthermore, these switches frequently have unacceptably large differentials, which means that the position of the operating element at which actuation of the switch to one state occurs differs substantially from the position of the actuation element at which actuation of the switch to the other state occurs. If the differential is too large, then the temperature range that the controlled space experiences is also too large.

Thermostats with electronic components are generally known in the art. An example of an electro-mechanical thermostat that has been utilized in commercial, consumer and industrial applications is the T87 thermostat produced by Honeywell International, Inc. ("Honeywell") of Minneapolis, Minn. An example of the T87 thermostat is disclosed in the publication "Thermostats T87F," Form Number 60-2222-2, S.M. Rev. 4-86, which is incorporated herein by reference. Another example of the T87F thermostat is disclosed in the publication "T87F Universal Thermostat," Form Number 60-0830-3, S.M. Rev. 8-93, which is also incorporated herein by reference. The T87F thermostat, in particular, provides temperature control for residential heating, cooling or heating-cooling systems. U.S. Pat. No. 5,262,752, which is incorporated by reference, is an example of an electrical switch assembly that forms the temperature responsive element in a thermostat.

One of the problems encountered in the efficient utilization of many thermostats in use today is the problem of actuating an electro-mechanical switch with a slow-moving actuator, such as a bimetal element, without sacrificing the switch's electrical life. For example, electro-mechanical thermostats, such as the T87 line of thermostats manufactured by Honeywell, utilize a bimetal element as the temperature-sensing device. In the operation of the thermostat, the bimetal element moves a small amount at a slow rate. Actuating a switch directly off the bimetal element results in an inordinate amount of time spent, during the switching cycle, at or near snap-over. Electro-mechanical switches have low contact forces near snap-over and zero contact forces at snap-over. When the switch contact forces are low or zero, the amount of electrical resistance at the contact interface increases. As the electrical resistance to current passing through the switch increases, the heat also increases. The electrical life of an electro-mechanical switch is reduced with time as the current is carried at or near the snap-over points.

The present inventors have thus concluded, based on the foregoing, that a need exists for an improved apparatus, including a method thereof, for effectively actuating an electro-mechanical switch.

SUMMARY

The present invention generally relates to electro-mechanical switches and energy-storing actuators. In addition, the present invention relates to electro-mechanical switches and energy-storing actuators that can be adapted for use with thermostats.

In one aspect, the invention relates to a control device including a ferromagnetic armature configured to move between a first position and a second position, the ferromagnetic armature being biased in the first position, an energy-storing member positioned adjacent the ferromagnetic armature, the energy-storing member being configured to move between an attracting position and a non-attracting position based on a temperature of an environment surrounding the energy-storing member, a magnet coupled to the energy-storing member, and a ferromagnetic backstop. When the energy-storing member is in the non-attracting position, the magnet is positioned adjacent the ferromagnetic backstop and the ferromagnetic backstop holds the magnet and the energy-storing member in the non-attracting position. When the temperature of the environment changes by an actuating amount, the energy-storing member generates a force sufficient to snap from the non-attracting position to the attracting position. When the energy-storing member snaps from the non-attracting to the attracting position, the armature is caused to snap from the first position to the second position, thereby causing the device to transition from a first operating state to a second operating state.

In another aspect, the invention relates to a control device including a switch including a ferromagnetic armature configured to move between a first position, wherein the armature is biased in the first position, and a second position, wherein in the second position the armature actuates a plunger that causes the switch to snap from an open position to a closed position, and an energy-storing member positioned adjacent the ferromagnetic armature, the energy-storing member including a magnet and being configured to move the magnet between an attracting position and a non-attracting position based on a temperature of an environment surrounding the energy-storing member. When the energy-storing member positions the magnet in the attracting position, the magnet causes the armature to snap from the first position to the second position, thereby actuating the plunger and causing the switch to snap from an open position to a closed position.

In yet another aspect, the invention relates to a switching apparatus for a thermostat including a switch including a lever coupled to a ferromagnetic armature configured to move between a first position, wherein the armature is biased in the first position, and a second position, wherein in the second position the armature actuates a plunger that causes the switch to snap from an open position to a closed position, a bimetal member positioned adjacent the ferromagnetic armature, the bimetal member being configured to move between an attracting position and a non-attracting position based on a temperature of an environment surrounding the bimetal member, a magnet mounted on a free end of the bimetal member, a stop positioned between the ferromagnetic armature and the magnet, the stop including a first surface configured to engage the ferromagnetic armature and a second surface configured to engage the magnet, wherein the first surface is positioned to controlan amount of travel of the ferromagnetic armature, and wherein the stop is configured to provide a minimum distance between the magnet and the ferromagnetic armature, and a ferromagnetic backstop. When the bimetal member is in the non-attracting position, the magnet is positioned adjacent the ferromagnetic backstop and the ferromagnetic backstop holds the magnet and the bimetal member in the non-attracting position. When the temperature of the environment changes by an actuating amount, the bimetal member generates a force sufficient to snap from the non-attracting position to the attracting position. When the bimetal member snaps from the non-attracting to the attracting position, the armature is caused to snap from the first position to the second position, thereby actuating the plunger and causing the device to transition from the open position to the closed position.

In another aspect, the invention relates to a method for switching a thermostat from a first state to a second state, the method including: providing a switch including a ferromagnetic armature, the ferromagnetic armature having a first position in which the switch is in a closed position, and a second position in which the switch is in an open position; positioning a free end of a bimetal member including a magnet adjacent to the ferromagnetic armature; allowing the bimetal member and magnet to move towards and attract the ferromagnetic armature as a temperature of an environment surrounding the bimetal member changes, the magnet causing the ferromagnetic armature to snap from the first position to the second position towards the magnet; stopping the magnet prior to the magnet contacting the ferromagnetic armature; and allowing the switch to snap from the closed position to the open position because of the snap of the ferromagnetic armature.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternative forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The present invention generally relates to electro-mechanical switches and energy-storing actuators. In addition, the present invention relates to electro-mechanical switches and energy-storing actuators that can be adapted for use with thermostats. While the present invention is not so limited, an appreciation of the various aspects of the invention will be gained through a discussion of the examples provided below.

In accordance with the present invention, an example embodiment of the present invention may include an electro-mechanical thermostat comprising an energy-storing actuator and an electro-mechanical switch. Both the energy-storing actuator and the mechanical switch may exhibit a snap action, thereby enhancing the switching characteristics of the thermostat and reducing undesirable characteristics such as arcing, heat-rise, and/or unacceptably large differentials which may be associated with electro-mechanical switching.

I. Electro-Mechanical Thermostat

Figure 1:
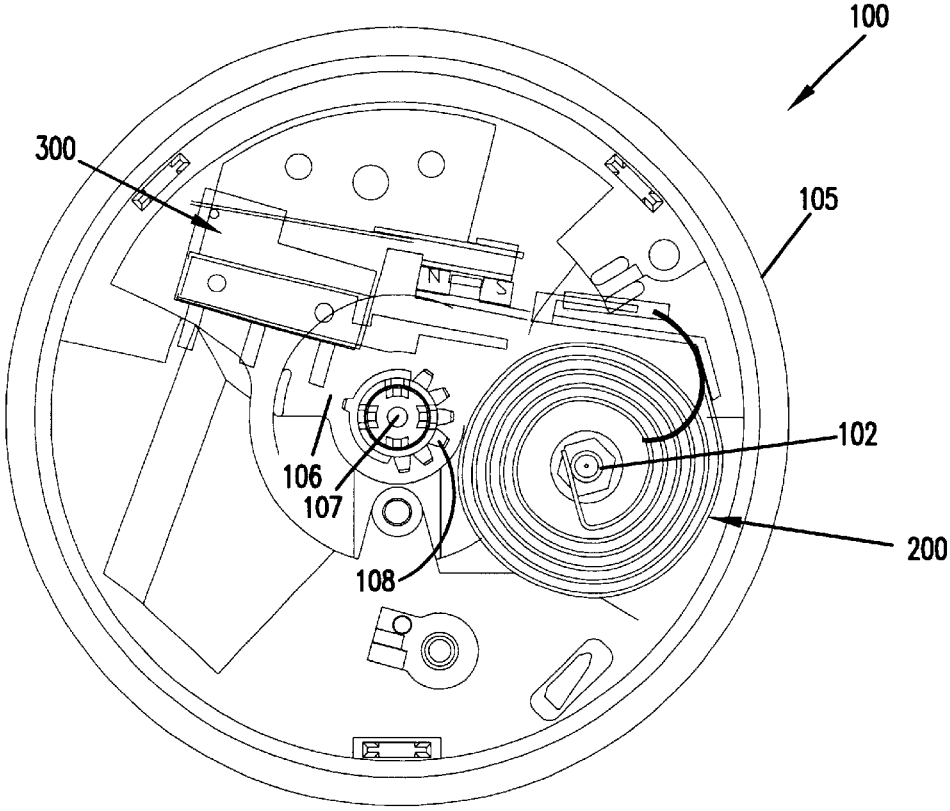
FIG. 1 is a schematic diagram of an embodiment of an electro-mechanical thermostat made in accordance with the present invention.

Referring now to FIG. 1, an embodiment of an electro-mechanical thermostat 100 is illustrated. The thermostat generally includes a housing 105, an energy-storing actuator, illustrated in the example embodiment as a bimetal element 200, and an electro-mechanical switch 300.

A nominal temperature set point, or the temperature at which the thermostat turns on or off, is established by the orientation of a coupling element 102. A user may change or establish the temperature set point by rotating a knob (not shown). The knob is coupled to a pinion 106 that rotates about a center shaft 107 of the housing 105. The pinion 106 is coupled, in turn, to a sector (not shown) by a set of gear teeth 108. The sector is coupled to the coupling element 102 using a frictional fit. In this manner, the user may rotate the knob, thereby changing the orientation of the coupling element 102 and the temperature set point of the thermostat.

II. Energy-Storing Actuator

Figure 2:
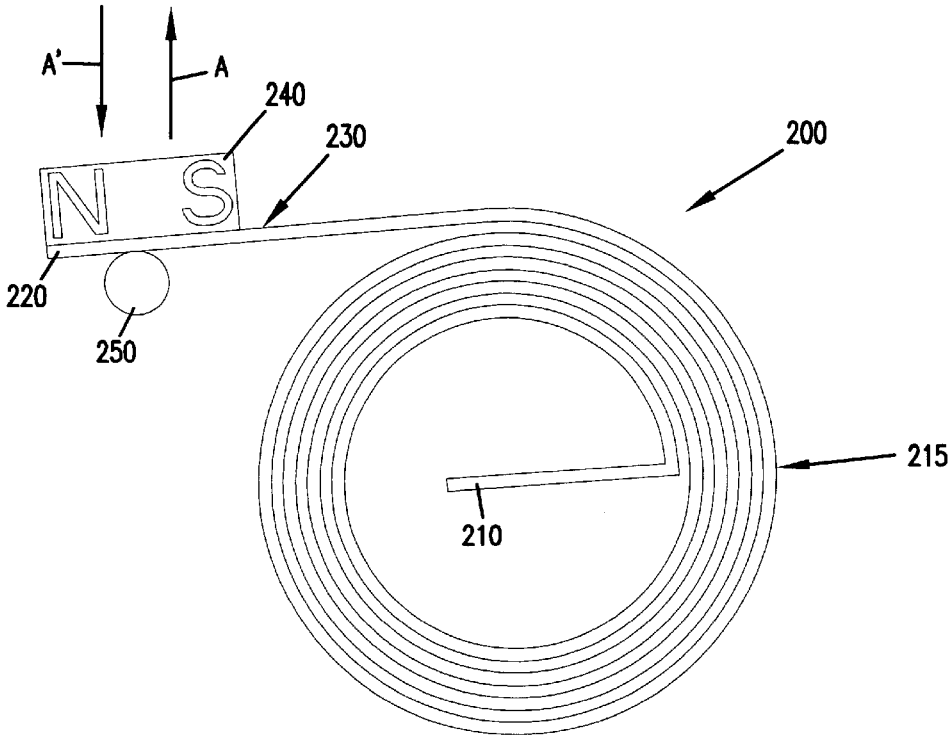
FIG. 2 is a schematic diagram drawing of an embodiment of an energy-storing actuator made in accordance with the present invention.
Figure 3:
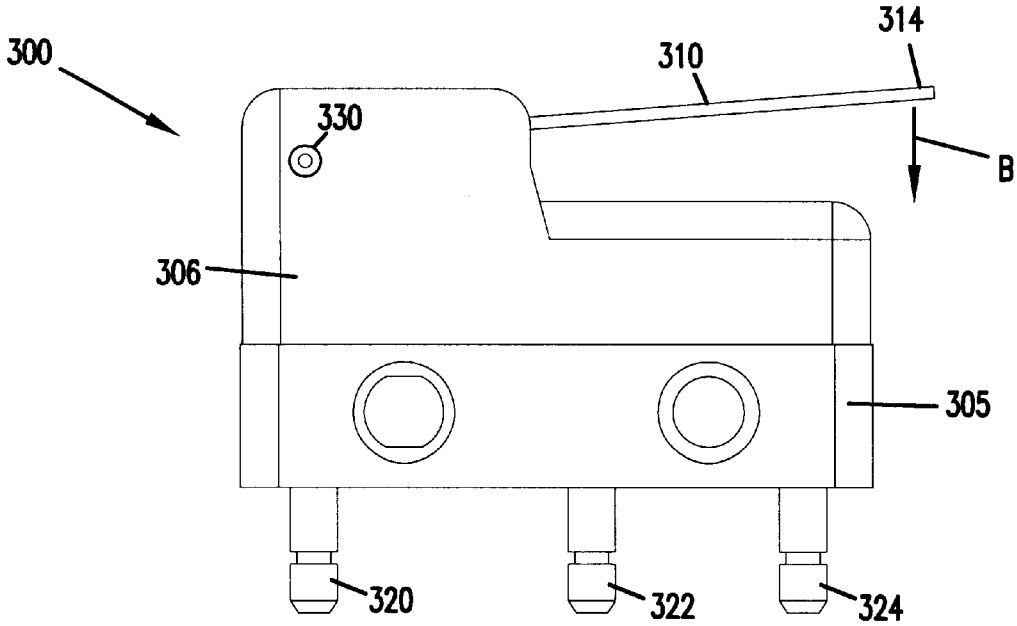
FIG. 3 is a side schematic diagram of an embodiment of an electro-mechanical switch made in accordance with the present invention.
Figure 4:
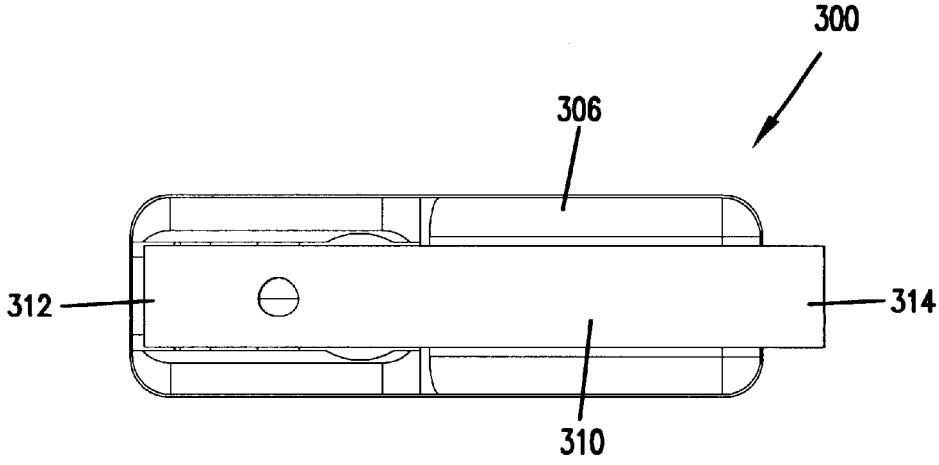
FIG. 4 is a top schematic diagram of the electro-mechanical switch shown in FIG. 3.

A first embodiment of the bimetal element 200 is illustrated in FIG. 2. The bimetal element 200 includes a fixed end 210 that is coupled to the electro-mechanical thermostat 100 by the coupling element 102 (shown in FIG. 1). The bimetal element 200 also includes a coiled mid-body 215 and a free end 220.

As is generally known in the art, the coiled mid-body 215 performs as an energy-storing actuator that coils and uncoils based on changes in a temperature of an environment surrounding the bimetal element 200. As the coiled mid-body 215 coils and uncoils, the free end 220 moves generally in a direction A and a direction A' opposite to the direction A.

A magnet 240 is coupled at the free end 220 on a surface 230 of the bimetal element 200. The magnet 240 may be, for example, a permanent magnet made of ferrite or neodymium ferrite. In the example embodiment shown, the magnet 240 is made of Koerdym80 by Magnequench® of Indianapolis, Ind. and is 0.220 inches by 0.360 inches by 0.160 inches in dimension. Because the magnet 240 is positioned at the free end 220, the magnet 240 travels generally in the directions A and A' as the free end 220 of the bimetal element 200 moves due to the coiling and uncoiling of the mid-body 215.

Also included with this embodiment of the bimetal element 200 is a ferromagnetic backstop 250 positioned adjacent to the free end 220 and the magnet 240. For example, the ferromagnetic backstop 250 may be made of steel or other material possessing good magnetic characteristics. The ferromagnetic backstop 250 is positioned to attract the magnet 240 and attached free end 220 of the bimetal element 200. In addition, as described in more detail below, the bimetal element 200 may generate and store sufficient energy to move the free end 220 in the direction A, thereby breaking the attraction between the magnet 240 and the ferromagnetic backstop 250.

Other energy-storing actuators besides a bimetal element may also be used. For example, a diaphragm may also be used.

III. Mechanical Switch

Referring now to FIGS. 3–8, the example electro-mechanical switch 300 is illustrated. The switch 300 generally includes a case 305, a cover 306, an operating member or lever 310, and terminals 320, 322, and 324. The lever 310 extends from a first end 312 positioned within the cover 306, to a second end 314 positioned outside the cover 306. The first end 312 of the lever 310 is positioned adjacent to and rides on the pin 330 so that the lever 310 pivots about the pin 330 as the second end 314 moves generally in a direction B. The terminals 320, 322, and 324 may be used to make electrical connections between components external to the electro-mechanical switch 300 and internal switch components.

Figure 6:
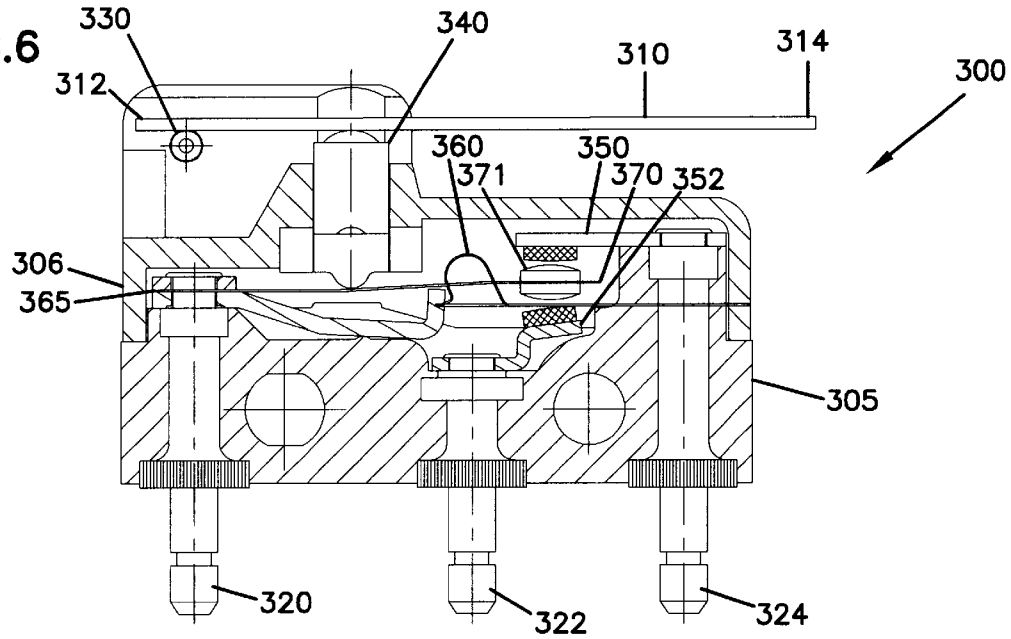
FIG. 6 is a cross-sectional view taken along line 6—6 of FIG. 5 showing the internal mechanisms of the electro-mechanical switch.
Figure 8:
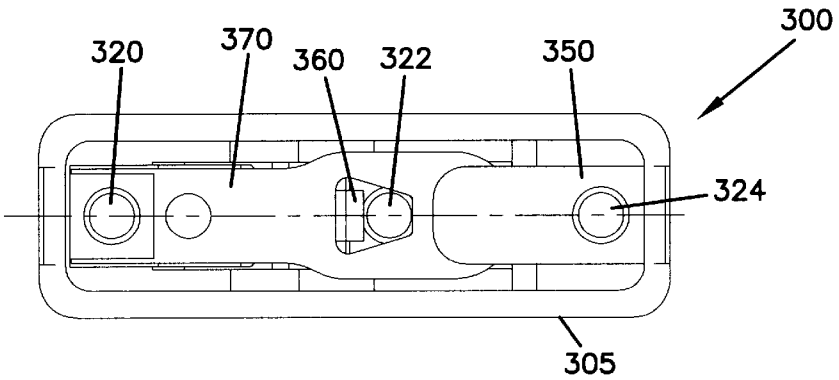
FIG. 8 is a top schematic diagram of the electro-mechanical switch shown in FIG. 7.
Figure 5:
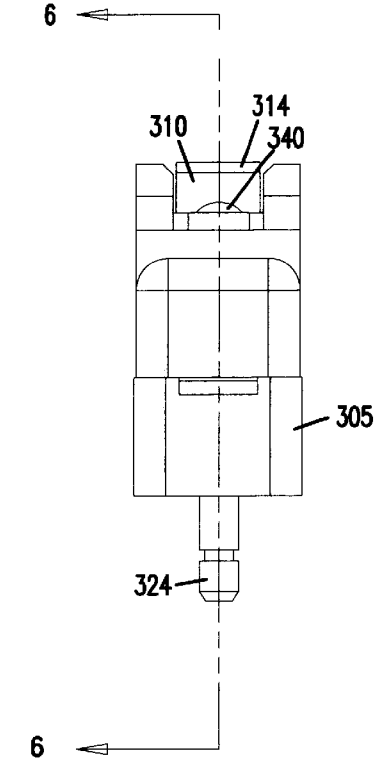
FIG. 5 is an end schematic diagram of the electro-mechanical switch shown in FIG. 3.
Figure 7:
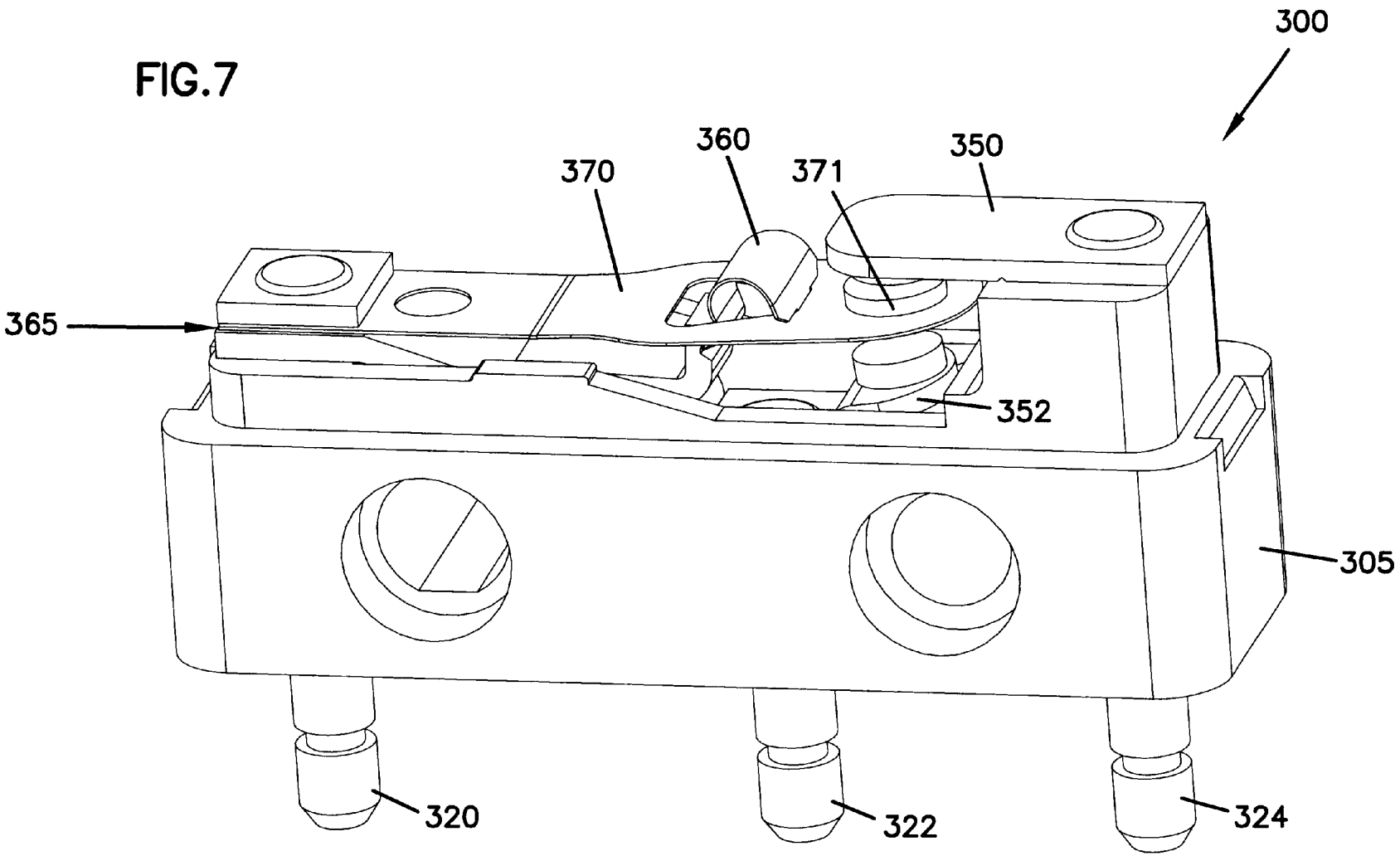
FIG. 7 is a side perspective view of the electro mechanical switch shown in FIG. 3 with the cover removed.

Referring now to FIGS. 6–8, the internal components of the electro-mechanical switch 300 are shown. These components include a plunger 340, a spring arm 370 coupled to the switch 300 by an anchor 365, a moveable contact 371, stationary contacts 350 and 352, and a spring member 360. When the plunger 340 is not depressed, the moveable contact 371 of the spring arm 370 is in contact with the upper stationary contact 350. In FIG. 6, the plunger 340 is illustrated in a partially depressed position. The spring arm 370 is moveable between the two stationery contacts 350 and 352. In operation, movement of the lever 310 depresses the plunger 340, which in turn depresses the spring arm 370. However, movement of the spring arm 370 is resisted by spring 360 until sufficient force is exerted by the plunger 340. At a critical point, the spring arm 370 has stored enough energy to overcome the opposing force of the spring 360, and the spring arm 370 snaps so that the moveable contact 371 contacts the lower stationary contact 352. Upon release of the plunger 340, the spring 360 causes the spring arm 370 to snap the moveable contact 371 back into contact with the stationary contact 350. In the example embodiment shown, the terminal 320 is coupled to the spring arm 370, the terminal 322 is coupled to the stationary contact 352, and the terminal 324 is coupled to the stationary contact 350.

Additional details regarding the embodiment of the electro-mechanical switch 300 can be found in the publication "Micro Switch General Technical Bulletin No. 13, Low Energy Switching" from Micro Switch of Freeport, Ill., a division of Honeywell Inc., which is hereby incorporated by reference in its entirety.

In the example embodiment shown, the switch 300 is a Honeywell Micro Switch Model No. X114055-SM (0146) produced by Honeywell, Inc. of Minneapolis, Minn. Other electro-mechanical switching apparatuses may also be used.

IV. First Embodiment of Switching Apparatus

Referring now to FIGS. 9–12, a first embodiment of a switching apparatus 400 is shown. The switching apparatus 400 generally includes the bimetal element 200 and the electro-mechanical switch 300.

In addition to the bimetal element 200 and the electro-mechanical switch 300, the second end 314 of the lever 310 of the electro-mechanical switch 300 is coupled to a ferromagnetic armature 410 positioned to extend from the end 314. For example, the ferromagnetic armature 410 may be made of steel or other material with good magnetic characteristics.

Further, a stop 420 is provided adjacent to the switch 300. The stop 420 is positioned to extend between the ferromagnetic armature 410 of the electro-mechanical switch 300 and the magnet 240 of the bimetal element 200. More specifically, the stop 420 is positioned so that a lower surface 422 of the stop 420 is positioned to engage a surface 242 of the magnet 240, and an upper surface 424 of the stop 420 is positioned to engage a surface 414 of the ferromagnetic armature 410. The location of the upper surface 424 sets the amount of travel of the ferromagnetic armature 410. For example, moving the upper surface 424 of the stop 420 in a direction away from the ferromagnetic armature 410 increases the travel of the armature (i.e. the switch travel).

A distance S between the upper and lower surfaces 424 and 422 is the spacer distance. The magnetic force between the magnet 240 and the ferromagnetic armature 410 increases exponentially as the distance S between the surfaces 424 and 422 decreases. The stop 420 limits the amount of magnetic force that can be developed between the magnet 240 and the ferromagnetic armature 410. The greater the distance S, the lower the magnetic force that is generated between the magnet 240 and the ferromagnetic armature 410 and the lower the energy that needs to be accumulated by the bimetal element 200 to cause the magnet 240 to move away from the armature ferromagnetic armature 410 (i.e. in the direction D', as described below in relation to FIG. 12). In the example embodiment, the stop 420 is made of plastic. Any other non-magnetic material may also be used.

Figure 9:
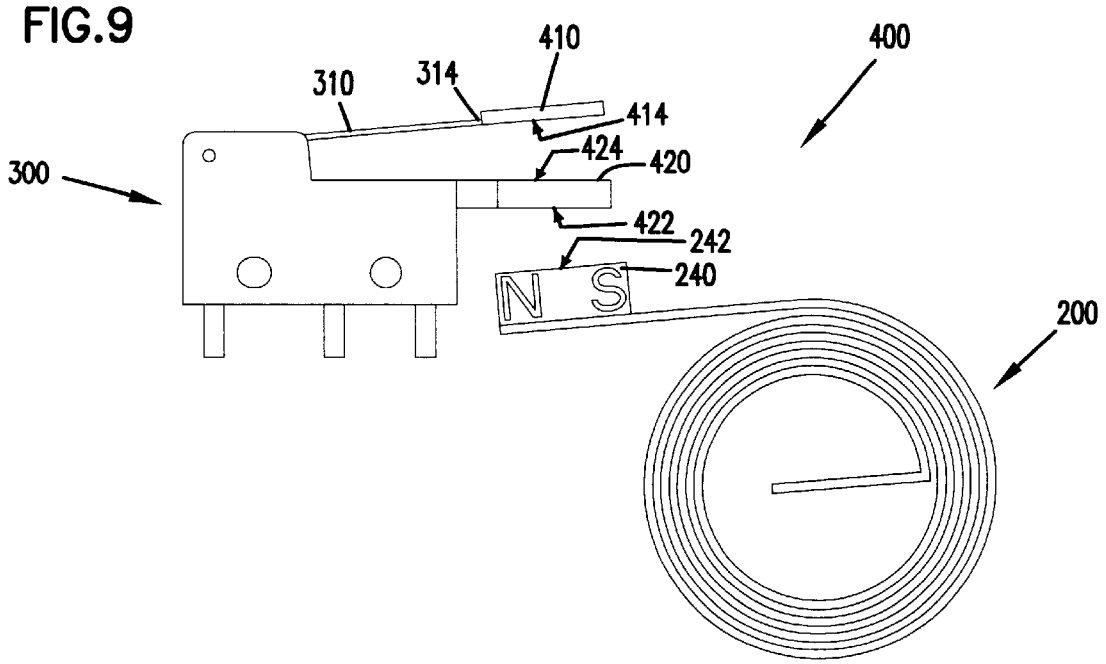
FIG. 9 is a schematic diagram of a first embodiment of a switching apparatus including an energy-storing actuator and an electro-mechanical switch in a first operating state.

As shown in FIG. 9, the switching apparatus 400 is in a first operating state. The magnet 240 on the bimetal element 200 is positioned at a distance with respect to the stop 420, and the lever 310 with the ferromagnetic armature 410 is positioned in a first position such that the switch 300 is in an open position.

Figure 10:
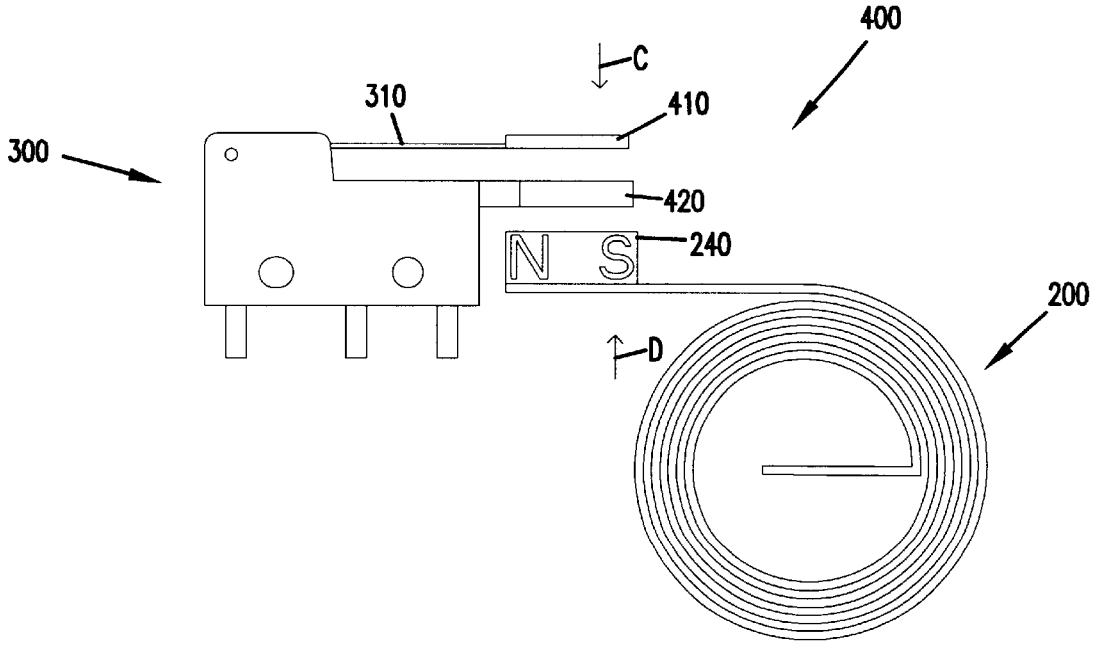
FIG. 10 is a schematic diagram of the switching apparatus of FIG. 9 moving towards a second operating state.

Referring now to FIG. 10, the switching apparatus 400 is illustrated traveling from the first operating state toward a second operating state. This transition is initiated by the bimetal element 200, which causes the magnet 240 to move closer to the stop 420 in a direction D as the temperature of the environment surrounding the bimetal element 200 decreases or cools. In the alternative, the bimetal element 200 could be oriented so that the magnet 240 moves in a direction D as the temperature of the environment increases. At the same time, magnetic attractive forces exerted by the magnet 240 on the ferromagnetic armature 410 increase as the magnet 240 moves in the direction D, causing the ferromagnetic armature 410 to move generally in a direction C towards the stop 420. In this transition between the first operating state and the second operating state, the electro-mechanical switch 300 has not reached its operating point, or the point at which the electro-mechanical switch 300 switches from the first operating state to the second operating state.

The switching apparatus 400 may be configured so as to transition from the first operating state to the second operating state when the temperature surrounding the apparatus 400 changes by an actuating amount. In one embodiment of the thermostat, the actuating amount may be set to 1 degree Fahrenheit so that the switch will transition from the first operating state to the second operating state, or vice versa, when the environmental temperature is 1 degree Fahrenheit above or below the set point for the thermostat. In other embodiments, the actuating amount may be set to 1.5 degrees. Other actuating amounts may also be used, as desired.

Figure 11:
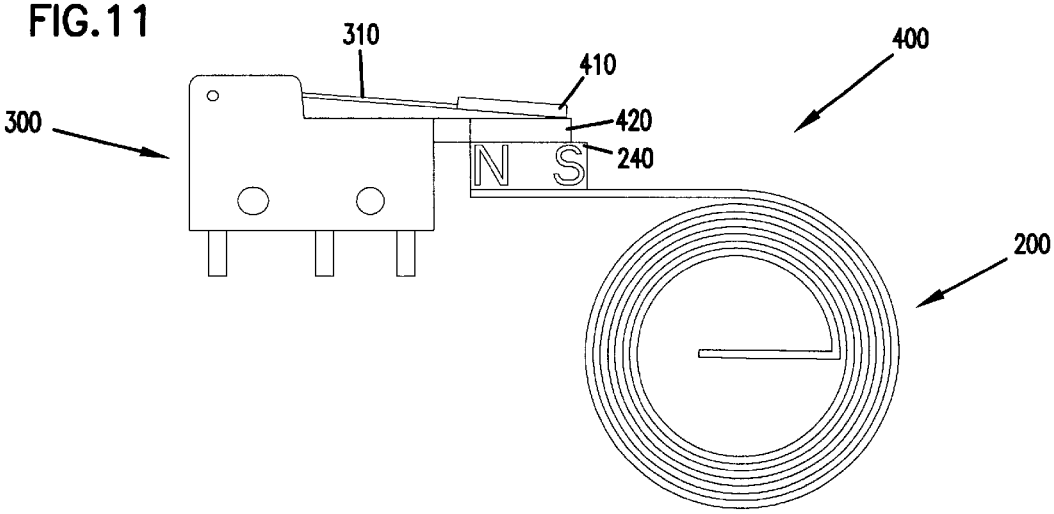
FIG. 11 is a schematic diagram of the switching apparatus of FIG. 9 in the second operating state.

Referring now to FIG. 11, the switching apparatus 400 has reached the second operating state. The bimetal element 200 has continued to move the magnet 240 towards the stop 420, and the ferromagnetic armature 410 that is coupled to the lever 310 has continued to move towards the stop 420 as the magnetic attractive forces on the armature 410 increase. At a critical point, the attractive forces between the magnet 240 and the ferromagnetic armature 410 increase to a point at which the magnet 240 and the ferromagnetic armature 410 move rapidly towards one another until each contacts the stop 420, as shown in FIG. 11. This rapid movement of the magnet 240 and the armature 410 is a first snap action. The first snap action causes the lever 310 coupled to the armature 410 to also move rapidly in the direction C, actuating the plunger 340 of the electro-mechanical switch 300. Movement of the plunger 340 causes the switch 300 to undergo a second snap action internally as the spring 360 of the electro-mechanical switch 300 is actuated. The switching apparatus 400 thereby moves from the first operating state to the second operating state.

Figure 12:
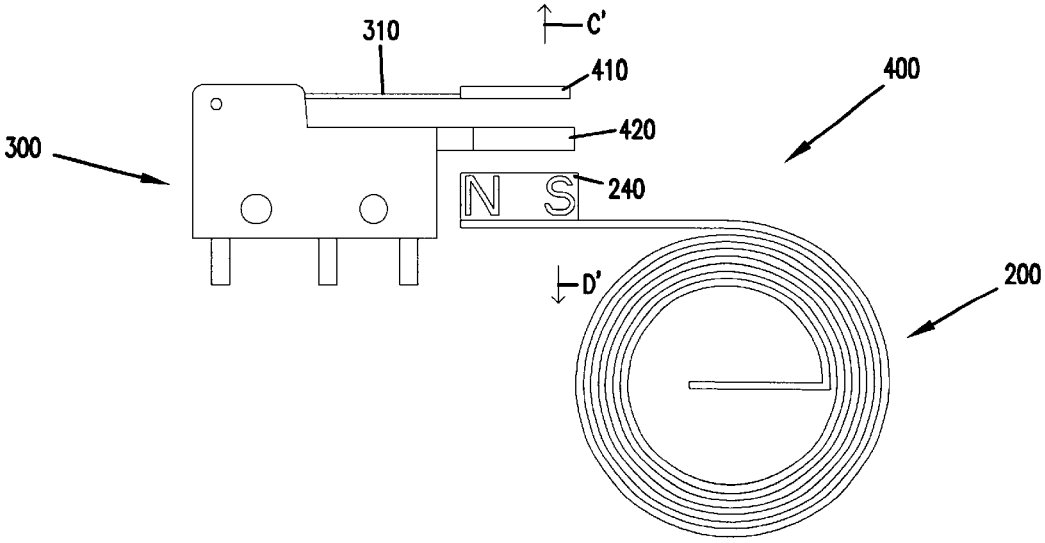
FIG. 12 is a schematic diagram of the switching apparatus of FIG. 9 moving towards the first operating state.

Referring now to FIG. 12, the switching apparatus is shown moving from the second operating state back towards the first operating state. This transition occurs as the temperature of the environment surrounding the bimetal element 200 increases or heats up, thereby causing the bimetal element 200 to begin to exert forces in a direction D'. In the alternative, the bimetal 200 could be oriented so that the bimetal moves in a direction D' when the environment cools. When sufficient energy is stored in the bimetal element 200 to break the attraction between the magnet 240 and the ferromagnetic armature 410, the magnet 240 is moved in the direction D' by the bimetal element 200 and the armature 410 moves in an opposite direction C' back towards the first operating state. At a certain point, the magnet 240 has moved a sufficient distance in the direction D' so that the ferromagnetic armature 410 moves far enough in the direction C' past the operating point of the switch 300, causing the switch to undergo a snap action due to the spring 360 (see FIGS. 6–8) in the electromagnetic switch 300, and allowing the switching apparatus 400 to return to the first operating state, as is illustrated in FIG. 9.

In the example embodiment shown, the bimetal element 200 is configured to exhibit a given bimetal spring rate. The bimetal spring rate defines how much force must be applied to cause the bimetal element 200 to deflect a given amount (e.g., from a non-attracting position to an attracting position). In addition, the electro-mechanical switch 300 is configured to exhibit a given switch spring rate defining how much force must be applied to cause the ferromagnetic armature 410 to deflect a given amount (e.g., to cause the electro-mechanical switch 300 to snap from the first operating state to the second operating state). Further, the magnet 240 is configured (e.g., magnet size and materials used to make the magnet) to provide a given magnetic attractive force.

In the example embodiment, the bimetal spring rate, the switch spring rate, and the magnet 240 are configured so that, at the critical point, the bimetal spring rate allows the attractive force between the magnet 240 and the ferromagnetic armature 410 to cause the magnet 240 to snap from the non-attracting position to the attracting position. When the magnet 240 snaps to the attracting position, the switch spring rate is configured to allow the ferromagnetic armature 410 of the switch 300 to snap from the first operating position to the second operating position. Therefore, in the embodiment shown, the bimetal spring rate and the switch spring rate of the switching apparatus 400 are configured so that the magnet 240 snaps from the non-attracting to the attracting position prior to the switch 300 snapping from the first operating position to the second operating position. The bimetal spring rate, switch spring rate, and the configuration of the magnet 240, as well as the relative positions of each of the components, can be modified to optimize the switching apparatus 400.

In the example embodiment shown, and without limitation, the magnet force necessary to cause snap over (i.e. transition from the first operating position to the second operating position) can be expressed as shown in Equation 1, wherein the gap is the distance between the magnet 240 and the ferromagnetic armature 410, where the magnet 240 is made of Koerdym80 by Magnequench® and has dimensions of 0.220 inches by 0.360 inches by 0.160 inches.

$$f_m = 60e^{-20(gap)} \tag{1}$$

In the example embodiment shown, the bimetal spring rate constant (Kb) is 110 gm/in and the switch spring rate constant (Ksw) is 139 gm/in. The spring rates of the bimetal element 200 and the switch 300 act in series. Therefore, a system spring rate constant (Keq) can be calculated as shown in Equation 2.

$$Keq = \frac{Kb \times Ksw}{Kb + Ksw} \tag{2}$$

Using Equation 2, the system spring rate constant Keq for the example embodiment is calculated as 61.4 gm/in.

Snap over occurs when the slope of the magnet force $f_m$ exceeds the slope of the spring rate for the system. Using the system spring rate constant Keq and Equation 1, the gap at snap over for the shown embodiment can be calculated as 0.148 in. The example numeric values for the spring rate constants and gap provided herein are specific to the example embodiment shown. Various other configurations can be used, and each configuration can be constructed with spring constants and gaps different from the numeric values provided above.

In this manner, the switching apparatus 400 may travel between the first and second operating states through a double snap action. The double snap action may be advantageous, for example, to isolate the electro-mechanical switch from the bimetal element, should the performance of the bimetal element deteriorate due, for example, to the accumulation of foreign matter on the bimetal element and permanent magnet.

V. Second Embodiment of Switching Apparatus

Figure 13:
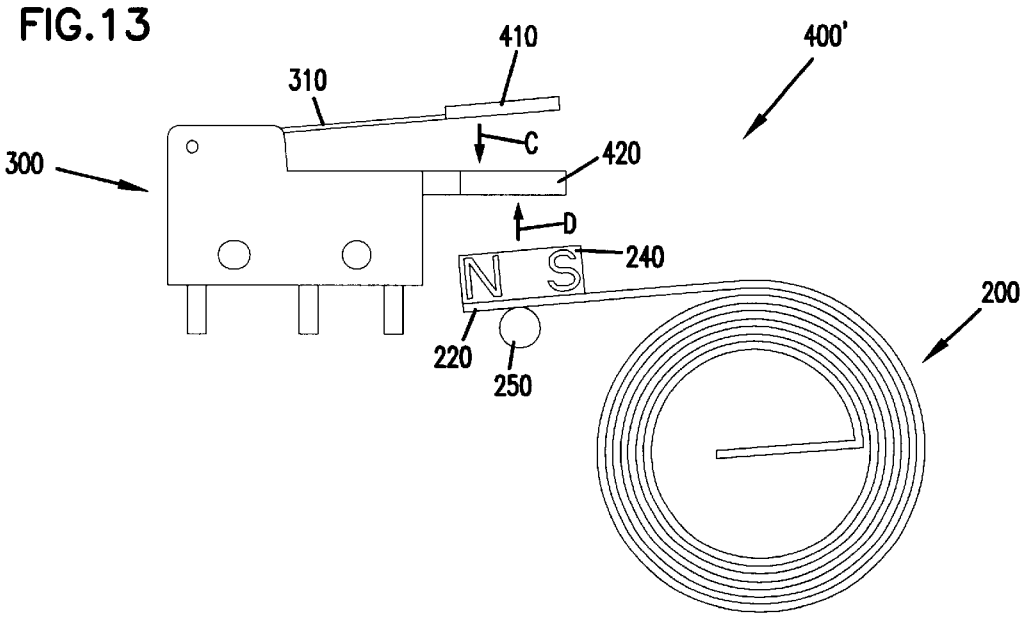
FIG. 13 is a schematic diagram of a second embodiment of a switching apparatus including an energy-storing actuator and an electro-mechanical switch in a first operating state.
Figure 14:
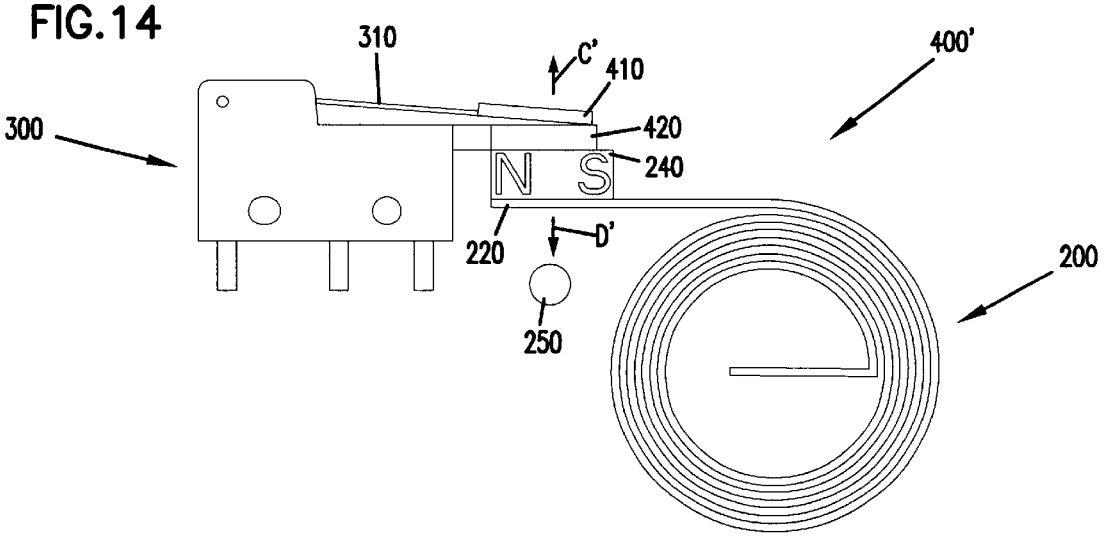
FIG. 14 is a schematic diagram of the switching apparatus of FIG. 13 in the second operating state.

Referring now to FIGS. 13 and 14, an embodiment of a second switching apparatus 400' is shown. The switching apparatus 400' is similar to the switching apparatus 400, except that the switching apparatus 400' includes a ferromagnetic backstop 250.

In FIG. 13, the switching apparatus 400' is in the first operating state. The free end 220 of the bimetal 200, with the magnet 240, contacts and is magnetically attracted to the ferromagnetic backstop 250. As the temperature surrounding the bimetal element 200 decreases, causing the bimetal element to store energy, the bimetal element 200 attempts to move the free end 220 with the magnet 240 towards the stop 420 as the bimetal 200 attempts to uncoil. Alternatively, the bimetal element 200 may be oriented to uncoil as the temperature increases. However, the attractive forces between the magnet 240 and the ferromagnetic backstop 250 do not allow the free end 220 of the bimetal 200 to travel towards the stop 420 immediately. Therefore, the bimetal element 200 remains in a stationary position and stores the energy generated by its tendency to uncoil.

Finally, the energy stored in the bimetal element 200 is sufficient to overcome the attractive forces between the magnet 240 and the ferromagnetic backstop 250. At this point, the free end 220 of the bimetal element 200 causes the magnet 240 to move rapidly towards the stop 420 in the direction D because of the force of the bimetal element 200 and the attractive force between the magnet 240 and the ferromagnetic armature 410. At nearly the same time, the attractive forces of the magnet 240 cause the ferromagnetic armature 410 of the electro-mechanical switch 300 to move rapidly towards the stop 420 in the direction C, thereby causing the lever 310 of the switch 300 to undergo an enhanced first snap action. This is illustrated in FIG. 14.

Referring now to FIG. 14, when the magnet 240 and the armature 410 undergo the enhanced snap action, this in turn causes the switch 300 to undergo a second snap action, thereby causing the apparatus 400' to transition from the first operating state to the second operating state.

As the temperature of the environment surrounding the bimetal element 200 changes once again, the free end 220 of the bimetal element 200 attempts to move in the direction D'. However, because of the attractive forces between the magnet 240 and the ferromagnetic armature 410, the free end 220 is unable to move in the direction D', but instead the bimetal element 200 stores the energy. When enough energy is stored in the bimetal element 200 to cause the magnet 240 to move away from the armature 410, the magnet 240 is moved in the direction D', and a speed of this movement is increased due to the attractive forces between the magnet 240 and the ferromagnetic backstop 250. At nearly the same instant, the armature 410 moves back in the direction C', causing the switching apparatus 400' to transition from the second operating state back to the first operating state.

In this manner, the ferromagnetic backstop 250 may provide an enhanced snap action for the bimetal element 200 and the ferromagnetic armature 410, which may be advantageous to increase the rate at which the switch transitions from the first operating state to the second operating state. In addition, the ferromagnetic backstop 250 may allow for a wider range of electro-mechanical switches to be used. For example, an electro-mechanical switch having a lower operating force may be used.

VI. Alternative Embodiments

Many modifications can be made to the example disclosed herein. For example, in the examples provided, the switching apparatus is shown as part of a thermostat. However, the switching apparatus has many other applications besides thermostats in which a rapid succession of snap actions would be desirable.

For example, the construction and/or configuration of the thermostat, and specifically the bimetal element, can be modified. In one alternative embodiment, the bimetal element is configured to cause the magnet to approach the armature as the temperature surrounding the bimetal element increases and to cause the magnet to move away from the armature as the temperature decreases. Other modifications are possible.

For example, the bimetal element could be replaced with a floating device coupled to the magnet 240. The floating device could be positioned within a container that holds liquid so that the floating device floats on a surface of the liquid and rises as the amount of liquid in the container increases. When the floating device reaches a given height in the container, the attractive forces between the magnet and the ferromagnetic armature of an electro-mechanical switch may be sufficient so that the magnet actuates the switch by a snap action. The switch could, in turn, undergo a second snap action to transition from a first operating state to a second operating state. This type of arrangement may be used, for example, as a liquid-level indicator or to turn on/off a flow of the liquid when the amount of liquid in the container has reached a certain height.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A control device comprising:

a housing;

a coupling element , an orientation of the coupling element establishing a temperature set point;

a pinion rotating about a center shaft of the housing, the pinion being coupled, in turn, to a sector by a set of gear teeth, the sector being coupled to the coupling elememt such that rotating the pinion changes the orientation of the coupling element and thereby the temperature set point of the thermostat;

a ferromagnetic armature configured to move between a first position and a second position, the ferromagnetic armature being biased in the first position;

an energy-storing member positioned adjacent the ferromagnetic armature and coupled to the coupling element, the energy-storing member being configured to move between an attracting position and a non-attracting position based on a temperature of an environment surrounding the energy-storing member;

a magnet coupled to the energy-storing member; and a ferromagnetic backstop;

wherein, when the energy-storing member is in the non-attracting position, the magnet is positioned adjacent the ferromagnetic backstop and the ferromagnetic backstop holds the magnet and the energy-storing member in the non-attracting position;

wherein, when the temperature of the environment changes by an actuating amount, the energy-storing member generates a force sufficient to snap from the non-attracting position to the attracting position; and wherein, when the energy-storing member snaps from the non-attracting to the attracting position, the armature is caused to move from the first position to the second position, thereby causing the device to transition from a first operating state to a second operating state.

2. The device of claim 1, further comprising a stop positioned between the ferromagnetic armature and the magnet.

3. The device of claim 2, wherein the stop includes a first surface configured to engage the ferromagnetic armature and a second surface configured to engage the magnet.

4. The device of claim 1, further comprising a switch coupled to the ferromagnetic armature and configured to move between an open position, when the armature is in the first position, and a closed position, when the armature moves to the second position, and thereby actuates a plunger that causes the switch to snap from the open position to the closed position.

5. The device of claim 1, wherein the energy-storing member is a bimetal element.

6. A control device comprising:

a switch including a ferromagnetic armature configured to move between a first position, wherein the armature is biased in the first position, and a second position, wherein in the second position the armature actuates a plunger that causes the switch to snap from an open position to a closed position; and an energy-storing member positioned adjacent the ferromagnetic armature, the energy-storing member including a magnet and being configured to move the magnet between an attracting position and a non-attracting position based on a temperature of an environment surrounding the energy-storing member;

wherein, when the energy-storing member positions the magnet in the attracting position, the magnet causes the armature to snap from the first position to the second position, thereby actuating the plunger and causing the switch to snap from an open position to a closed position.

7. The device of claim 6, wherein the switch further includes a spring that is actuated by the plunger to snap from the open position to the closed position.

8. The device of claim 7, wherein the switch further includes a first contact and a second contact, and wherein the spring is configured to contact the first contact when in the open position and snap to contact the second contact when in the closed position.

9. The device of claim 6, further comprising a stop positioned between the ferromagnetic armature and the magnet coupled to the energy-storing member.

10. The device of claim 9, wherein the stop includes a first surface configured to engage the ferromagnetic armature and a second surface configured to engage the magnet.

11. The device of claim 10, wherein the first surface is positioned to control an amount of travel of the ferromagnetic armature.

12. The device of claim 9, wherein the stop is configured to provide a minimum distance between the magnet and the ferromagnetic armature.

13. The device of claim 6, wherein the energy-storing member is a bimetal element.

14. The device of claim 6, wherein the switch includes a switch spring rate and the energy-storing member includes a member spring rate, and wherein the switch spring rate and the member spring rate are configured so that an attracting force sufficient to cause the energy-storing member to snap from the non-attracting to the attracting position is achieved prior to an actuation force sufficient to cause the switch to snap from the open position to the closed position.

15. The device of claim 6, wherein the device is configured so that the switch and the energy-storing member act in series.

16. The device of claim 15, wherein the device is configured such that a device spring rate is a combination of a switch spring rate of the switch and an energy-storing spring rate of the energy-storing member and wherein the switch snaps from the open position to the closed position when a slope of an attracting force of the magnet exceeds a slope of the device spring rate.

17. A switching apparatus for a thermostat comprising:

a switch including a lever coupled to a ferromagnetic armature configured to move between a first position, wherein the armature is biased in the first position, and a second position, wherein in the second position the armature actuates a plunger that causes the switch to snap from an open position to a closed position;

a bimetal member positioned adjacent the ferromagnetic armature, the bimetal member being configured to move between an attracting position and a non-attracting position based on a temperature of an environment surrounding the bimetal member;

a magnet mounted on a free end of the bimetal member;

a stop positioned between the ferromagnetic armature and the magnet, the stop including a first surface configured to engage the ferromagnetic armature and a second surface configured to engage the magnet, wherein the first surface is positioned to control an amount of travel of the ferromagnetic armature, and wherein the stop is configured to provide a minimum distance between the magnet and the ferromagnetic armature; and a ferromagnetic backstop;

wherein, when the bimetal member is in the non-attracting position, the magnet is positioned adjacent the ferromagnetic backstop and the ferromagnetic backstop holds the magnet and the bimetal member in the non-attracting position;

wherein, when the temperature of the environment changes by an actuating amount, the bimetal member generates a force sufficient to snap from the non-attracting position to the attracting position; and wherein, when the bimetal member snaps from the non-attracting to the attracting position, the armature is caused to snap from the first position to the second position, thereby actuating the plunger and causing the device to transition from the open position to the closed position.

18. A method for switching a thermostat from a first state to a second state, the method comprising:

providing a switch including a ferromagnetic armature, the ferromagnetic armature having a first position in which the switch is in a closed position, and a second position in which the switch is in an open position;

positioning a free end of a bimetal member including a magnet adjacent to the ferromagnetic armature;

allowing the bimetal member and magnet to move towards and attract the ferromagnetic armature as a temperature of an environment surrounding the bimetal member changes, the magnet causing the ferromagnetic armature to snap from the first position to the second position towards the magnet;

stopping the magnet prior to the magnet contacting the ferromagnetic armature; and allowing the switch to snap from the closed position to the open position because of the snap of the ferromagnetic armature.

19. The method of claim 18, further comprising providing a ferromagnetic backstop to attract the magnet and limit movement of the bimetal element until the bimetal element exerts sufficient energy to break free from the ferromagnetic backstop.

20. A control device comprising:

a rotatable knob coupled to an energy-storing member by at least one gear member including a plurality of teeth, so that rotation of the knob changes an orientation of the energy-storing member and thereby a temperature set point of the thermostat;

a ferromagnetic armature configured to move between a first position and a second position;

a magnet coupled to the energy-storing member, wherein the magnet is positioned adjacent the ferromagnetic armature, and the energy-storing member is configured to move the magnet between an attracting position and a non-attracting position based on a temperature of an environment surrounding the energy-storing member; and a ferromagnetc backstop;

wherein, when the magnet coupled to the energy-storing member is in the non-attracting position, the magnet is positioned adjacent the ferromagnetic backstop and the ferromagnetic backstop holds the magnet in the non-attracting position;

wherein, when the temperature of the environment changes by an actuating amount, the energy-storing member generates a force sufficient to snap the magnet from the non-attracting position to the attracting position; and wherein, when the energy-storing member snaps the magnet from the non-attracting to the attracting position, the armature is caused to move from the first position to the second position, thereby causing the device to transition from a first operating state to a second operating state.

* * * * *